US008628626B2

(12) United States Patent
Fluck et al.

(10) Patent No.: US 8,628,626 B2
(45) **Date of Patent: *Jan. 14, 2014**

(54) DIBASIC ESTERS UTILIZED AS TERPENE CO-SOLVENTS, SUBSTITUTES AND/OR CARRIERS IN TAR SAND/BITUMEN/ASPHALTENE CLEANING APPLICATIONS

(75) Inventors: David Fluck, Elkton, MD (US); Amit Sehgal, Marlton, NJ (US); Satyen Trivedi, East Windsor, NJ (US); Ruela Talingting Pabalan, Burlington, NJ (US); Charles Aymes, Monmouth Junction, NJ (US)

(73) Assignee: Rhodia Operations, Aubervilliers (FR)

( * ) Notice: Subject to any disclaimer, the term of this patent is extended or adjusted under 35 U.S.C. 154(b) by 0 days.

This patent is subject to a terminal disclaimer.

(21) Appl. No.: 13/374,033

(22) Filed: Dec. 8, 2011

(65) Prior Publication Data

US 2012/0149626 A1 Jun. 14, 2012

Related U.S. Application Data

(60) Provisional application No. 61/459,281, filed on Dec. 10, 2010.

(51) Int. Cl.
*B08B 3/04* (2006.01)
*C11D 1/72* (2006.01)

(52) U.S. Cl.
USPC ..... 134/39; 134/25.2; 134/25.3; 134/42; 510/101; 510/211; 510/356; 510/417; 510/421; 510/505; 514/937; 514/941; 514/943

(58) Field of Classification Search
USPC ..... 510/101, 211, 356, 417, 421, 505; 134/25.2, 25.3, 39, 42; 514/937, 941, 514/943
See application file for complete search history.

(56) References Cited

U.S. PATENT DOCUMENTS 4,470,928 A 9/1984 Kimura et al.
4,640,719 A 2/1987 Hayes et al.

(Continued)

FOREIGN PATENT DOCUMENTS

WO WO 94/17145 8/1994
WO WO 01/30957 A1 10/2000

(Continued)

OTHER PUBLICATIONS

Chuiba, et al., "TheUse of EgyptienFuselOil for thePreparation ofSomePlasticizers Compatible withPolyvinylChloride",IndianJournal of Tech., vol. 23, Aug. 1985, pp. 309-311.

(Continued)

*Primary Examiner* — Brian P Mruk

(57) ABSTRACT

A heavy oil cleaning composition comprising: a) a blend of dibasic esters comprising dialkyl methylglutarate and at least one of a dialkyl adipate or dialkyl ethylsuccinate; b) at least one terpene; and c) at least one surfactant. Also described are methods for delivering a solvent at reduced concentration comprising the steps of: a) obtaining a terpene-based solvent; and b) mixing the terpene-based solvent with a carrier fluid (the carrier fluid comprising a microemulsion of i) a blend of dibasic esters selected from the group consisting of dialkyl methylglutarate, dialkyl adipate, dialkyl ethylsuccinate, dialkyl succinate, dialkyl glutarate and any combination thereof, ii) at least one surfactant selected from the group consisting of a terpene alkoxylate, an alcohol alkoxylate and any combination thereof; and iii) water) in order to obtain a mixture to clean heavy oils.

6 Claims, 7 Drawing Sheets

(56) References Cited

U.S. PATENT DOCUMENTS

| | | | | |
|---|---|---|---|---|
| 4,673,524 | A | 6/1987 | Dean | |
| 4,867,800 | A | 9/1989 | Dishart et al. | |
| 4,934,391 | A | 6/1990 | Futch et al. | |
| 5,024,780 | A | 6/1991 | Leys | |
| 5,252,780 | A | 10/1993 | Ramos et al. | |
| 5,346,640 | A | 9/1994 | Leys | |
| 5,419,848 | A | 5/1995 | Van Eenam | |
| 5,573,710 | A | 11/1996 | McDonnell | |
| 5,672,579 | A | 9/1997 | Diaz et al. | |
| 6,090,769 | A * | 7/2000 | Vlasblom | 510/365 |
| 6,172,031 | B1 | 1/2001 | Stevens | |
| 6,265,367 | B1 | 7/2001 | Callaghan et al. | |
| 6,284,720 | B1 | 9/2001 | Opre | |
| 6,306,223 | B1 | 10/2001 | Joye | |
| 6,355,113 | B1 | 3/2002 | Nalewajek et al. | |
| 6,706,676 | B2 | 3/2004 | Swensen | |
| 7,199,092 | B2 | 4/2007 | Lu et al. | |
| 7,271,140 | B2 | 9/2007 | Durrant | |
| 7,309,684 | B2 | 12/2007 | Filippini et al. | |
| 7,786,179 | B2 * | 8/2010 | Talingting-Pabalan et al. | 516/181 |
| 8,153,577 | B2 * | 4/2012 | Fluck et al. | 510/417 |
| 8,222,194 | B2 * | 7/2012 | Trivedi et al. | 510/174 |
| 2003/0216268 | A1 | 11/2003 | Swensen | |
| 2004/0000329 | A1 | 1/2004 | Albu et al. | |
| 2004/0200007 | A1 | 10/2004 | Heim | |
| 2006/0135683 | A1 | 6/2006 | Adam et al. | |
| 2007/0093404 | A1 | 4/2007 | Gross et al. | |
| 2009/0281012 | A1 * | 11/2009 | Trivedi et al. | 510/138 |

FOREIGN PATENT DOCUMENTS

| | | | |
|---|---|---|---|
| WO | WO 2005/028606 | A1 | 3/2005 |
| WO | WO 2006/055713 | A1 | 5/2006 |

OTHER PUBLICATIONS

Solo Pak Pty Ltd, "Earth Renewable Heavy Duty Degreaser", Material Safety Data Sheet, pp. 1-6, Sep. 25, 2008.

* cited by examiner

Fresh Crude: Infinity + D-Limonene Dilutions

- Fresh crude stripes dried for 3-4 hrs in a vented hood
- Dilutions of Infinity + d-Limonene concentrates were then tested
- Infinity +d-L (10% & 25%) were diluted by addition of 25% water and 50 % water
- Dilutions were clear solutions
- Dilutions of (25% d-L + Infinity) blend are fairly effective in cleaning fresh crude

DIBASIC ESTERS UTILIZED AS TERPENE CO-SOLVENTS, SUBSTITUTES AND/OR CARRIERS IN TAR SAND/BITUMEN/ASPHALTENE CLEANING APPLICATIONS

CROSS-REFERENCE TO RELATED APPLICATIONS

The application claims benefit of U.S. Provisional Application No. 61/459,281, filed on Dec. 10, 2010, herein incorporated by reference.

FIELD OF THE INVENTION

This invention relates to compositions containing novel dibasic esters for use in cleaning surfaces and mining equipment soiled with, for example, tar, bitumen, asphaltene, asphaltene-containing substances, any combination thereof and the like.

BACKGROUND OF THE INVENTION

Some commercial products contain d-limonene or pinene, which are derived from naturally occurring products such as oranges, etc. D-Limonene is used extensively in several degreasing and/or cleaning formulations, especially, cleaning asphaltenes and heavy crude residues. Though derived from a natural feedstock or sources, d-Limonene is flammable and has adverse aquatic toxicity (pollutant). Moreover, because it is based on a natural sources or feedstock, terpenes and, especially, d-Limonene are sometimes subject to price fluctuations and availability constraints depending on seasonal crop yield.

Current commercially available cleaning products Megasol™ and Citrikleen™ have d-limonene as the primary active ingredient. While both exhibit cleaning properties, they have two drawbacks associated with them; d-limonene is a sensitizer or mild-to-moderate dermal, eye, and upper respiratory tract irritant and also has an odor, which in high concentrations becomes intolerable to many people. Further these current terpene based solvents are not "rinsable", meaning they cannot be easily rinsed off with water as they leave a slippery reside and pose additional safety concerns for workers utilizing these solvents (e.g., slipping). Reduced levels of terpene, e.g., d-limonene, thereof while maintaining performance in cost effective cleaning applications is therefore desirable.

Thus, what is needed is an environmentally friendly cleaning composition that has substantially lower toxicity, lower flammability, greater biodegradability, higher flash point, reduced vapor pressure, lower odor, and/or lower VOC and is suitable for treating soiled or contaminated surfaces, in particular, surfaces soiled with tar sands, bitumen, asphaltene and the like, or a combination thereof.

SUMMARY OF THE INVENTION

This invention utilizes dibasic esters as solvents or co-solvents in cleaning compositions as high performance, environmentally preferable components compared to currently available solvents/formulations for cleaning applications. In one embodiment, the formulations described herein are for any cleaning application, in particular, tar sand, bitumen, asphaltene and the like, or a combination thereof (hereinafter referred to sometimes as "heavy oil cleaning"). It is understood, however, that the cleaning applications can be utilized in institutional, industrial or consumer applications such as graffiti cleaning, painted-substrate cleaning, ink cleaning, including printer ink, metal substrate cleaning, wood surface cleaning, plastic substrate cleaning, stain-spot cleaning, textile cleaning, industrial hand cleaning, degreasing, paint stripping, or the like, or any combination thereof.

Generally, heavy oil cleaning is needed to remove tar, tar sand, bitumen, asphalt or asphaltene contaminants, often times mixed with soil, from heavy duty machinery, for example, machinery and equipment used in oil-field servicing, trucks used for hauling, mining and drilling equipment, and the like. For example, crude oil may dry (or lose volatiles) on equipment, transporting ships, rigs, etc. leaving heavy oil residues rich in asphaltenes. As another example, tar-sand builds up on mining equipment, such as trucks, during its extraction and conveying. In addition to the tar-sand, mud and lime (used for dust suppression) also accumulate on the equipment to form a mixed mass. This continually built-up and many times baked-on mass must be removed once it reaches a level were efficient operation is impaired. Normally, a cleaning agent is applied and allowed to soak into this semi baked-on mass for a period of time, which can disrupt normal operations because of the soaking time. After a set time (for example, 20 minutes or greater) it is sprayed off with power water-jets.

The dibasic ester solvents utilized in the heavy oil cleaning compositions described herein also present an improved Health, Safety, and Environmental (HSE) profile. They are readily biodegradable, non-flammable (with high flash points), non-toxic, non-irritant and non-sensitizers. They also have a low vapor pressure (non-VOC per CARB 310 and EU 1999/13/EC), and high boiling points while maintaining low viscosities. They have a mild/neutral odor. As there is a push for environmentally-friendly or "green" solutions, these properties of the solvents described make them attractive for applications ranging from home and personal care, to institutional cleaners, or for industrial processes where safety and is paramount. However, as discussed above, such low vapor pressure/VOC green solvents also present the problem that the solvent does not vaporize and may leave residual solvent on the surface being cleaned which may not be acceptable for some applications.

In another aspect, described herein are methods to use a terpene solvent extender (hereafter sometimes referred to as "solvent extender"), for example, certain blends of dibasic ester compositions, as a replacement, supplement for terpene-based solvents, or vehicle to deliver terpene-based solvents (e.g., d-limonene) at reduced concentrations while maintaining or improving cleaning performance. It has been surprisingly discovered that the cleaning effectiveness of a reduced may be improved or maintained by the inclusion of a solvent extender to substitute and/or supplement the terpene-based solvent. In addition, the presence of the solvent extender may provide an improved environmental profile of the cleaning composition. This utility of the dibasic ester compositions described herein as a "d-limonene extender" allows formulators to adjust the concentration of d-limonene to ameliorate some of the drawbacks encountered.

Accordingly, the compositions described herein include a terpene solvent extender to which improves or maintains efficacy of the composition, while having a reduced terpene solvent concentration. The solvent extender is typically incorporated in amounts ranging from about 0.5% to about 60%, typically from about 5% to about 50%, and more typically about 10% to about 40% by weight of the composition.

In some embodiments, the heavy oil cleaning formulations described herein are microemulsions, which are thermodynamically stable and clear emulsions as opposed to milky unstable emulsions which require agitation to maintain the oil phase in water. The use of such oil-continuous microemulsions further reduces the concentrations of the terpenes while delivering them actively on the surfaces being cleaned.

The present invention will become apparent from the following detailed description and examples, which comprises in one aspect, is a heavy oil cleaning composition comprising: a) a solvent extender; b) at least one terpene-based solvent; and c) at least one surfactant. In one embodiment, the heavy oil cleaning composition can optionally include: i) at least one glycol ether, ii) at least one alkanolamine, iii) at least one polyol, iv) at least one sulfosuccinate, v) water, or any combination of components i) through v). The solvent extender can, in one embodiment, comprises a blend of dibasic esters comprising dialkyl methylglutarate, dialkyl ethylsuccinate and, optionally, dialkyl adipate In another aspect, a heavy oil cleaning composition comprises: a) a solvent extender comprising at least two of dialkyl methylglutarate, dialkyl adipate, dialkyl ethylsuccinate, dialkyl succinate and/or dialkyl glutarate; b) at least one terpene; c) at least one glycol ether; d) at least one alkanolamine; e) at least one polyol; and f) at least one sulfosuccinate. The heavy oil cleaning composition can further comprise water. In one embodiment, the blend of dibasic esters comprises dialkyl methylglutarate, dialkyl adipate and dialkyl ethylsuccinate. In another embodiment, the blend of dibasic esters comprises dialkyl methylglutarate and dialkyl ethylsuccinate.

The terpene can be selected from an alpha pinene, a beta pinene, d-limonene, oc-pinene, derivatives thereof and/or any combination thereof. The glycol ether can be selected from alkyl glycol ethers, diethylene glycol butyl ether (DGBE), ethylene glycol monomethyl ether (CH3OCH2CH2OH), ethylene glycol monoethyl ether (CH3CH2OCH2CH2OH), ethylene glycol monopropyl ether (CH3CH2CH2OCH2CH2OH), ethylene glycol monoisopropyl ether ((CH3)2CHOCH2CH2OH), ethylene glycol monobutyl ether (CH3CH2CH2CH2OCH2CH2OH), ethylene glycol monophenyl ether (C6H5OCH2CH2OH), ethylene glycol monobenzyl ether (2-benzyloxyethanol, C6H5CH2OCH2CH2OH), diethylene glycol monomethyl ether (CH3OCH2CH2OCH2CH2OH), diethylene glycol monoethyl ether (CH3CH2OCH2CH2OCH2CH2OH), diethylene glycol mono-n-butyl ether (CH3CH2CH2CH2OCH2CH2OCH2CH2OH) and/or any combination thereof. The alkanolamine can be selected from triethanolamine, diethanolamine, monoethanolamine and/or any combination thereof.

The polyol can be selected from triols, diols, glycerin, polyether triols, polyethylene glycol, polypropylene glycol, poly(tetramethylene ether)glycol and/or any combination thereof. The sulfosuccinate can be selected from alkyl sulfosuccinates, alkyl sodium sulfonates, dialkyl sulfosuccinates and/or any combination thereof.

In one embodiment, the blend of dibasic esters comprises:

(i) from about 5-25%, by weight of the blend, a first dibasic ester of formula:

(IX)

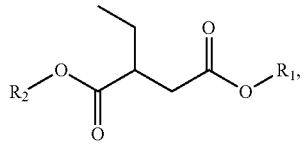

(ii) from about 70-95%, by weight of the blend, a second dibasic ester of formula:

(X)

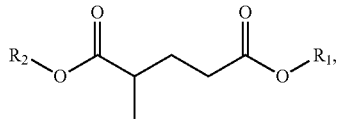

and (iii) from about 0-5%, by weight of the blend, a third dibasic ester of formula:

(XI)

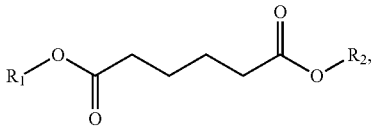

wherein $R_1$ and $R_2$ are hydrocarbon groups individually selected from $C_1$-$C_{13}$ alkyl, $C_1$-$C_{13}$ aryl, $C_1$-$C_{13}$ alkaryl, $C_1$-$C_{13}$ alkoxy, $C_1$-$C_{13}$ alkylarylalkyl, $C_1$-$C_{13}$ arylalkyl, $C_1$-$C_{13}$ alkylamidoalkyl or $C_1$-$C_{13}$ alkylaminoalkyl. In another embodiment, $R_1$ and $R_2$ can be hydrocarbon groups individually selected from methyl, ethyl, propyl, isopropyl, n-butyl, pentyl, isoamyl, hexyl, heptyl or octyl.

In one embodiment, the sulfosuccinate is of formula (I):

(I)

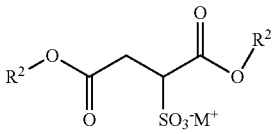

wherein R2 is selected from the group consisting of alkyl, —CH2CH2OH, aryl, alkaryl, alkoxy, alkylarylalkyl, arylalkyl, alkylamidoalkyl and alkylaminoalkyl; wherein -M+- is hydrogen, an alkali metal, sodium, potassium or ammonium salt.

In one embodiment, the blend of dibasic esters comprises dialkyl glutarate, dialkyl adipate and dialkyl succinate. In one embodiment, the alkanolamine is triethanolamine. In one embodiment, the polyol is a polyether triol. In one embodiment, the sulfosuccinates is dioctyl sodium sulfosuccinate.

In one particular aspect, described herein are heavy oil cleaning compositions comprising: a) from about 1% to about 50% by weight of the composition, a blend of dibasic esters comprising dialkyl methylglutarate and at least one of a dialkyl adipate or dialkyl ethylsuccinate; b) from about 1% to about 50% by weight of the composition, at least one terpene; c) from about 0% to about 7% by weight of the composition, at least one glycol ether; d) from about 0% to about 7% by weight of the composition, at least one alkanolamine; e) from about 0% to about 7% by weight of the composition, at least one polyol; f) from about 1% to about 35% by weight of the composition, at least one sulfosuccinate; and g) from about 1% to about 50% by weight of the composition, water.

In another aspect, described herein are heavy oil cleaning compositions comprising: a) from about 1% to about 50% by weight of the composition, a blend of dibasic esters comprising dialkyl methylglutarate and at least one of a dialkyl adipate or dialkyl ethylsuccinate; b) from about 1% to about 60% by weight of the composition, at least one terpene-based solvent; and c) from about 1% to about 60% by weight of the composition, at least one surfactant chosen from a non-ionic, cationic, anionic, zwitterionic or amphoteric surfactant.

In yet another aspect, described herein are methods of cleaning surfaces soiled with one or more heavy oils comprising: (a) providing any of the cleaning compositions described herein; (b) contacting the cleaning composition with a surface soiled with a heavy oil; and (c) removing the used cleaning composition from the surface through spray washing. In such an embodiment, only rinsing is required to remove the cleaning composition and contaminants from the surface (as opposed to additional steps like scrubbing and steps to remove remaining reside), which does not leave a slippery or slick reside like traditional terpene-based cleaners. In one embodiment, the soiled surface is contacted with the heavy oil cleaning compositions described herein for a minimum of 20 minutes, after which time the contaminated surface/cleaning composition is removed through spray washing or water/fluid/solvent rinsing, more typically, forceful rinsing. In other embodiments, the soiled surface is contacted with the heavy oil cleaning compositions described herein for a minimum of 1 minute. In further embodiments, the soiled surface is contacted with the heavy oil cleaning compositions described herein for a minimum of 5, 10 or 15 minutes.

In a further aspect, described herein are methods for delivering a solvent at reduced concentration comprising the steps of: a) obtaining a terpene-based solvent; and b) mixing the terpene-based solvent with a carrier fluid or solvent extender (the solvent extender comprising a microemulsion of i) a blend of dibasic esters selected from the group consisting of dialkyl methylglutarate, dialkyl adipate, dialkyl ethylsuccinate, dialkyl succinate, dialkyl glutarate and any combination thereof, ii) at least one surfactant selected from the group consisting of a terpene alkoxylate, an alcohol alkoxylate and any combination thereof; and iii) water) in order to obtain a mixture, whereby the removal rate of a contaminant of the mixture is equal or greater than that of the solvent alone. In some embodiments, removal rates can be measured visually, by image analysis, and/or by gravimetric analysis. The contaminants can be tar sands, bitumen, asphaltene, an asphaltene-containing substance, a combination thereof or the like.

In one embodiment, the terpene-based solvent comprises d-limonene. In yet another embodiment, the blend of dibasic esters selected from the group consisting of dialkyl methylglutarate, and at least one of dialkyl adipate or dialkyl ethylsuccinate.

In another embodiment, the at least one surfactant is of formula:

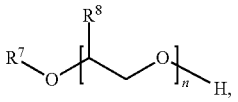

wherein $R^7$ is a hydrogen or a branched or linear hydrocarbon chain containing from about 5 to about 25 carbon atoms; $R^8$ is a hydrogen or a hydrocarbon chain containing from about 1 to about 5 carbon atoms; and -n- is an integer from about 1 to about 30.

DETAILED DESCRIPTION

Figure 1:
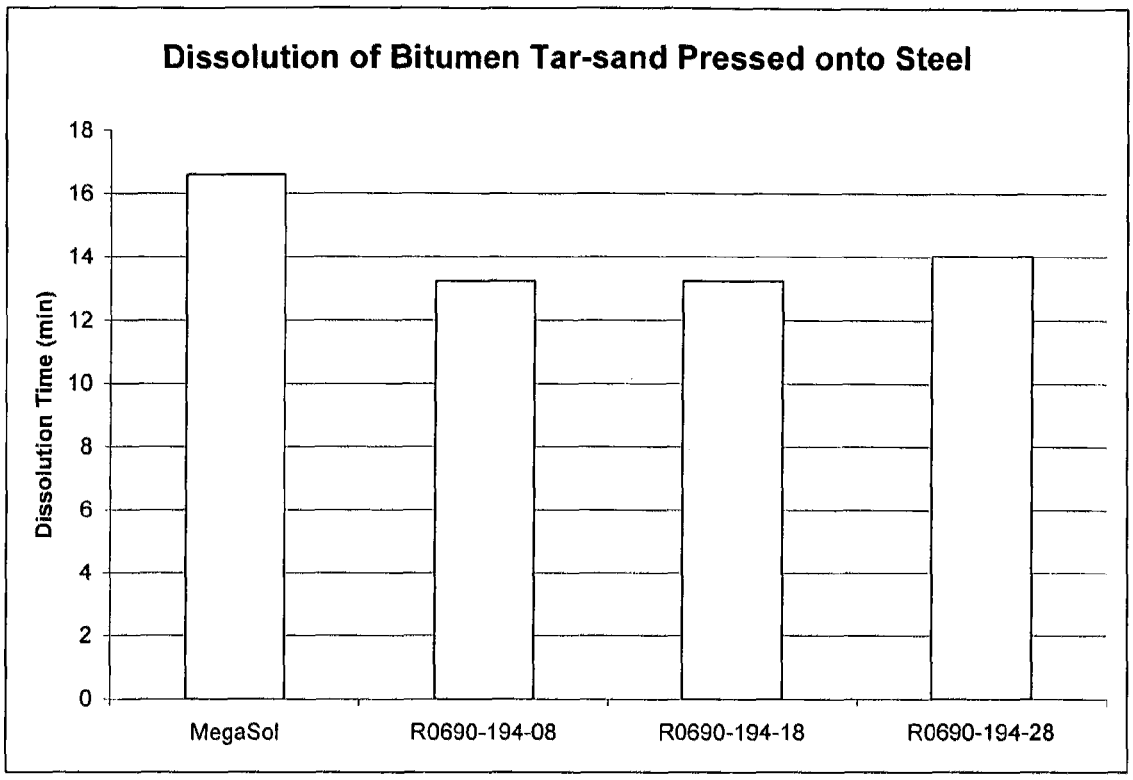
FIG. 1 illustrates the dissolution time of bitumen tar-sand (pressed into steel) into the cleaning compositions described herein versus a benchmark.

As used herein, the term "alkyl" means a saturated straight chain, branched chain, or cyclic hydrocarbon radical, including but not limited to, methyl, ethyl, n-propyl, iso-propyl, n-butyl, sec-butyl, t-butyl, pentyl, n-hexyl, and cyclohexyl.

As used herein, the term "aryl" means a monovalent unsaturated hydrocarbon radical containing one or more six-membered carbon rings in which the unsaturation may be represented by three conjugated double bonds, which may be substituted one or more of carbons of the ring with hydroxy, alkyl, alkenyl, halo, haloalkyl, or amino, including but not limited to, phenoxy, phenyl, methylphenyl, dimethylphenyl, trimethylphenyl, chlorophenyl, trichloromethylphenyl, aminophenyl, and tristyrylphenyl.

As used herein, the term "alkylene" means a divalent saturated straight or branched chain hydrocarbon radical, such as for example, methylene, dimethylene, trimethylene.

As used herein, the terminology "($C_r$—$C_s$)" in reference to an organic group, wherein r and s are each integers, indicates that the group may contain from r carbon atoms to s carbon atoms per group.

As used herein, the terminology "surfactant" means a compound that when dissolved in an aqueous medium lowers the surface tension of the aqueous medium.

The cleaning composition of the present invention has desirable qualities including one or a combination of being: substantially lower toxicity, lower flammability, greater biodegradable, higher flash point, reduced vapor pressure and lower odor, and lower VOC.

Described herein are heavy oil cleaning composition comprising a blend of dibasic esters. In one embodiment, the blend comprises adducts of alcohol and linear diacids, the adducts having the formula $R_1$—OOC-A-COO—$R_2$ wherein $R_1$ and/or $R_2$ comprise, individually, a $C_1$-$C_{12}$ alkyl, more typically a $C_1$-$C_8$ alkyl, and A comprises a mixture of —$(CH_2)_4$—, —$(CH_2)_3$, and —$(CH_2)_2$—. In another embodiment, $R_1$ and/or $R_2$ comprise, individually, a $C_4$-$C_{12}$ alkyl, more typically a $C_4$-$C_8$ alkyl. In one embodiment, $R_1$ and $R_2$ can individually comprise a hydrocarbon group originating from fusel oil. In one embodiment, $R_1$ and $R_2$ individually can comprise a hydrocarbon group having 1 to 8 carbon atoms. In one embodiment, $R_1$ and $R_2$ individually can comprise a hydrocarbon group having 5 to 8 carbon atoms.

In one embodiment, the blend comprises adducts of alcohol and branched or linear diacids, the adducts having the formula $R_1$—OOC-A-COO—$R_2$ wherein $R_1$ and/or $R_2$ comprise, individually, a $C_1$-$C_{12}$ alkyl, more typically a $C_1$-$C_8$ alkyl, and A comprises a mixture of —$(CH_2)_4$—, —$CH_2CH_2CH(CH_3)$—, and —$CH_2CH(C_2H_5)$—. In another embodiment, $R_1$ and/or $R_2$ comprise, individually, a $C_4$-$C_{12}$ alkyl, more typically a $C_4$-$C_8$ alkyl. It is understood that the acid portion may be derived from such dibasic acids such as adipic, succinic, glutaric, oxalic, malonic, pimelic, suberic and azelaic acids, as well as mixtures thereof.

One or more dibasic esters used in the present invention can be prepared by any appropriate process. For example, a process for preparing the adduct of adipic acid and of fusel oil is, for example, described in the document "The Use of Egyptian Fusel Oil for the Preparation of Some Plasticizers Compatible with Polyvinyl Chloride", Chuiba et al., Indian Journal of Technology, Vol. 23, August 1985, pp. 309-311.

The dibasic esters of the present invention can be obtained by a process comprising an "esterification" stage by reaction of a diacid of formula HOOC-A-COOH or of a diester of formula MeOOC-A-COOMe with a branched alcohol or a mixture of alcohols. The reactions can be appropriately catalyzed. Use is preferably made of at least 2 molar equivalents of alcohols per diacid or diester. The reactions can, if appropriate, be promoted by extraction of the reaction by-products and followed by stages of filtration and/or of purification, for example by distillation.

The diacids in the form of mixtures can in particular be obtained from a mixture of dinitrile compounds in particular produced and recovered in the process for the manufacture of adiponitrile by double hydrocyanation of butadiene. This process, used on a large scale industrially to produce the greater majority of the adiponitrile consumed worldwide, is described in numerous patents and works. The reaction for the hydrocyanation of butadiene results predominantly in the formulation of linear dinitriles but also in formation of branched dinitriles, the two main ones of which are methylglutaronitrile and ethylsuccinonitrile. The branched dinitrile compounds are separated by distillation and recovered, for example, as top fraction in a distillation column, in the stages for separation and purification of the adiponitrile. The branched dinitriles can subsequently be converted to diacids or diesters (either to light diesters, for a subsequent transesterification reaction with the alcohol or the mixture of alcohols or the fusel oil, or directly to diesters in accordance with the invention). For example, the blend of dibasic esters is derived or taken from the methylglutaronitrile product stream in the manufacture of adiponitrile.

Dibasic esters of the present invention may be derived from one or more by-products in the production of polyamide, for example, polyamide 6,6. In one embodiment, the cleaning composition comprises a blend of linear or branched, cyclic or noncyclic, $C_1$-$C_{20}$ alkyl, aryl, alkylaryl or arylalkyl esters of adipic diacids, glutaric diacids, and succinic diacids. In another embodiment, the cleaning composition comprises a blend of linear or branched, cyclic or noncyclic, $C_1$-$C_{20}$ alkyl, aryl, alkylaryl or arylalkyl esters of adipic diacids, methylglutaric diacids, and ethylsuccinic diacids Generally, polyamide is a copolymer prepared by a condensation reaction formed by reacting a diamine and a dicarboxylic acid. Specifically, polyamide 6,6 is a copolymer prepared by a condensation reaction formed by reacting a diamine, typically hexamethylenediamine, with a dicarboxylic acid, typically adipic acid.

In one embodiment, the blend of the present invention can be derived from one or more by-products in the reaction, synthesis and/or production of adipic acid utilized in the production of polyamide, the cleaning composition comprising a blend of dialkyl esters of adipic diacids, glutaric diacids, and succinic diacids (herein referred to sometimes as "AGS" or the "AGS blend"). In one embodiment, the blend of esters is derived from by-products in the reaction, synthesis and/or production of hexamethylenediamine utilized in the production of polyamide, typically polyamide 6,6). In one embodiment, the blend of dibasic esters is derived or taken from the methylglutaronitrile product stream in the manufacture of adiponitrile; the cleaning composition comprises a blend of dialkyl esters of methylglutaric diacids, ethylsuccinic diacids and, optionally, adipic diacids (herein referred to sometimes as "MGA", "MGN", "MGN blend" or "MGA blend").

The boiling point of the dibasic ester blend of the present invention is between the range of about 120° C. to 450° C. In one embodiment, the boiling point of the blend of the present invention is in the range of about 160° C. to 400° C.; in one embodiment, the range is about 210° C. to 290° C.; in another embodiment, the range is about 210° C. to 245° C.; in another embodiment, the range is the range is about 215° C. to 225° C. In one embodiment, the boiling point range of the blend of the present invention is between about 210° C. to 390° C., more typically in the range of about 280° C. to 390° C., more typically in the range of 295° C. to 390° C. In one embodiment, boiling point of the blend of the present invention is in the range of about 215° C. to 400° C., typically in the range of about 220° C. to 350° C.

In one embodiment, the blend of dibasic esters has a boiling point range of between about 300° C. and 330° C. Typically, the diisoamyl AGS blend is associated with this boiling point range. In another embodiment, the dibasic ester blend of the present invention has a boiling point range of between about 295° C. and 310° C. Typically, the di-n-butyl AGS blend is associated with this boiling point range. Generally, a higher boiling point, typically, above 215° C., or high boiling point range corresponds to lower VOC.

The dibasic esters or blend of dibasic esters are incorporated into a cleaning composition of the present invention which, in one embodiment, comprises (a) a blend of dialkyl esters of adipic, glutaric, and succinic diacids or a blend of dialkyl esters of methylglutaric and ethylsuccinic (and, optionally, adipic) diacids; (b) at least one terpene; (c) at least one surfactant, typically, at least one non-ionic surfactant; and, optionally, (d) water or a solvent. Additional components may be added including but not limited to co-solvent and a co-surfactant. The co-surfactant can be any number of cationic, amphoteric, zwitterionic, anionic or nonionic surfactants, derivatives thereof, as well as blends of such surfactants. However, it is understood that the cleaning compositions of the present invention with additional components still remain infinitely dilutable and environmentally-friendly.

In one embodiment, the nonionic surfactants generally includes but is not limited to amides such as alkanolamides, ethoxylated alkanolamides, ethylene bisamides; esters such as fatty acid esters, glycerol esters, ethoxylated fatty acid esters, sorbitan esters, ethoxylated sorbitan; ethoxylates such as alkylphenol ethoxylates, alcohol ethoxylates, tristyrylphenol ethoxylates, mercaptan ethoxylates; end-capped and EO/PO block copolymers such as ethylene oxide/propylene oxide block copolymers, chlorine capped ethoxylates, tetra-functional block copolymers; amine oxides such lauramine oxide, cocamine oxide, stearamine oxide, stearamidopropylamine oxide, palmitamidopropylamine oxide, decylamine oxide; fatty alcohols such as decyl alcohol, lauryl alcohol, tridecyl alcohol, myristyl alcohol, cetyl alcohol, stearyl alcohol, oleyl alcohol, linoleyl alcohol and linolenyl alcohol; and alkoxylated alcohols such as ethoxylated lauryl alcohol, trideceth alcohols; and fatty acids such as lauric acid, oleic acid, stearic acid, myristic acid, cetearic acid, isostearic acid, linoleic acid, linolenic acid, ricinoleic acid, elaidic acid, arichidonic acid, myristoleic acid and any combinations thereof.

In one embodiment, the nonionic surfactant is a glycol such as polyethylene glycol (PEG), alkyl PEG esters, polypropylene glycol (PPG) and derivatives thereof. The nonionic surfactant can be one or more branched alcohol alkoxylates, one or more linear alcohol alkoxylates or a combination of one or more branched alcohol alkoxylates and one or more linear alcohol alkoxylates. In one embodiment, the nonionic surfactant is at least one branched $C_5$-$C_{20}$ alcohol butoxylate, at least one linear $C_5$-$C_{20}$ alcohol butoxylate, at least one branched $C_5$-$C_{20}$ alcohol propoxylate, at least one linear $C_5$-$C_{20}$ alcohol propoxylate, at least one branched $C_5$-$C_{20}$ alcohol ethoxylate, at least one linear $C_5$-$C_{20}$ alcohol ethoxylate and any combination thereof. In one exemplary embodiment, the nonionic surfactant is a $C_6$-$C_{13}$ alcohol ethoxylate and, more typically, a $C_8$-$C_{12}$ alcohol ethoxylate.

In one embodiment, cationic co-surfactants include but are not limited to quaternary ammonium compounds, such as cetyl trimethyl ammonium bromide (also known as CETAB or cetrimonium bromide), cetyl trimethyl ammonium chloride (also known as cetrimonium chloride), myristyl trimethyl ammonium bromide (also known as myrtrimonium bromide or Quaternium-13), stearyl dimethyl distearyldimonium chloride, dicetyl dimonium chloride, stearyl octyldimonium methosulfate, dihydrogenated palmoylethyl hydroxyethylmonium methosulfate, isostearyl benzylimidonium chloride, cocoyl benzyl hydroxyethyl imidazolinium chloride, dicetyl dimonium chloride and distearyldimonium chloride; isostearylaminopropalkonium chloride or olealkonium chloride; behentrimonium chloride; as well as mixtures thereof.

In another embodiment, anionic co-surfactants include but are not limited to linear alkylbenzene sulfonates, alpha olefin sulfonates, paraffin sulfonates, alkyl ester sulfonates, alkyl sulfates, alkyl alkoxy sulfates, alkyl sulfonates, alkyl alkoxy carboxylates, alkyl alkoxylated sulfates, monoalkyl phosphates, dialkyl phosphates, sarcosinates, sulfosuccinates, isethionates, and taurates, as well as mixtures thereof. Commonly used anionic surfactants that are suitable as the anionic surfactant component of the composition of the present invention include, for example, ammonium lauryl sulfate, ammonium laureth sulfate, triethylamine lauryl sulfate, triethylamine laureth sulfate, triethanolamine lauryl sulfate, triethanolamine laureth sulfate, monoethanolamine lauryl sulfate, monoethanolamine laureth sulfate, diethanolamine lauryl sulfate, diethanolamine laureth sulfate, lauric monoglyceride sodium sulfate, sodium lauryl sulfate, sodium laureth sulfate, potassium lauryl sulfate, potassium laureth sulfate, sodium-monoalkyl phosphates, sodium dialkyl phosphates, sodium lauroyl sarcosinate, lauroyl sarcosine, cocoyl sarcosine, ammonium cocyl sulfate, ammonium lauryl sulfate, sodium cocyl sulfate, sodium trideceth sulfate, sodium tridecyl sulfate, ammonium trideceth sulfate, ammonium tridecyl sulfate, sodium cocoyl isethionate, disodium laureth sulfosuccinate, sodium methyl oleoyl taurate, sodium laureth carboxylate, sodium trideceth carboxylate, sodium lauryl sulfate, potassium cocyl sulfate, potassium lauryl sulfate, monoethanolamine cocyl sulfate, sodium tridecyl benzene sulfonate, and sodium dodecyl benzene sulfonate. Branched anionic surfactants are particularly preferred, such as sodium trideceth sulfate, sodium tridecyl sulfate, ammonium trideceth sulfate, ammonium tridecyl sulfate, and sodium trideceth carboxylate.

Amphoteric co-surfactants acceptable for use include but are not limited to derivatives of aliphatic secondary and tertiary amines in which the aliphatic radical can be straight chain or branched and wherein one of the aliphatic substituents contains from about 8 to about 18 carbon atoms and one contains an anionic water solubilizing group. Specific examples of suitable amphoteric surfactants include the alkali metal, alkaline earth metal, ammonium or substituted ammonium salts of alkyl amphocarboxy glycinates and alkyl amphocarboxypropionates, alkyl amphodipropionates, alkyl amphodiacetates, alkyl amphoglycinates, and alkyl amphopropionates, as well as alkyl iminopropionates, alkyl iminodipropionates, and alkyl amphopropylsulfonates, such as for example, cocoamphoacetate cocoamphopropionate, cocoamphodiacetate, lauroamphoacetate, lauroamphodiacetate, lauroamphodipropionate, lauroamphodiacetate, cocoamphopropyl sulfonate caproamphodiacetate, caproamphoacetate, caproamphodipropionate, and stearoamphoacetate.

Suitable zwitterionic co-surfactants include but are not limited to alkyl betaines, such as cocodimethyl carboxymethyl betaine, lauryl dimethyl carboxymethyl betaine, lauryl dimethyl alpha-carboxy-ethyl betaine, cetyl dimethyl carboxymethyl betaine, lauryl bis-(2-hydroxy-ethyl)carboxy methyl betaine, stearyl bis-(2-hydroxy-propyl)carboxymethyl betaine, oleyl dimethyl gamma-carboxypropyl betaine, and lauryl bis-(2-hydroxypropyl)alpha-carboxyethyl betaine, amidopropyl betaines, and alkyl sultaines, such as cocodimethyl sulfopropyl betaine, stearyldimethyl sulfopropyl betaine, lauryl dimethyl sulfoethyl betaine, lauryl bis-(2-hydroxy-ethyl)sulfopropyl betaine, and alkylamidopropyl-hydroxy sultaines.

In one embodiment, a heavy oil cleaning composition comprises a) a blend of dibasic esters comprising dialkyl methylglutarate and at least one of a dialkyl adipate or dialkyl ethylsuccinate; b) at least one terpene; c) optionally, at least one surfactant; d) optionally, at least one glycol ether; e) optionally, at least one alkanolamine; f) optionally, at least one polyol; g) optionally, at least one sulfosuccinate; and h) optionally, water.

In another embodiment, the at least one surfactant is of formula:

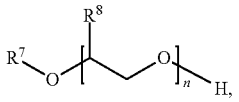

wherein $R^7$ is a hydrogen or a branched or linear hydrocarbon chain containing from about 5 to about 25 carbon atoms; $R^8$ is a hydrogen or a hydrocarbon chain containing from about 1 to about 5 carbon atoms; and -n- is an integer from about 1 to about 30.

The terpene can be selected from an alpha pinene, a beta pinene, d-limonene, oc-pinene, derivatives thereof and/or any combination thereof. Typically, the terpene is alpha pinene, beta pinene or d-limonene.

The glycol ether can be selected from alkyl glycol ethers, diethylene glycol butyl ether (DGBE), ethylene glycol monomethyl ether (CH3OCH2CH2OH), ethylene glycol monoethyl ether (CH3CH2OCH2CH2OH), ethylene glycol monopropyl ether (CH3CH2CH2OCH2CH2OH), ethylene glycol monoisopropyl ether ((CH3)2CHOCH2CH2OH), ethylene glycol monobutyl ether (CH3CH2CH2CH2OCH2CH2OH), ethylene glycol monophenyl ether (C6H5OCH2CH2OH), ethylene glycol monobenzyl ether (2-benzyloxyethanol, C6H5CH2OCH2CH2OH), diethylene glycol monomethyl ether (CH3OCH2CH2OCH2CH2OH), diethylene glycol monoethyl ether (CH3CH2OCH2CH2OCH2CH2OH), diethylene glycol mono-n-butyl ether (CH3CH2CH2CH2OCH2CH2OCH2CH2OH) and/or any combination thereof. Typically, the glycol ether is diethylene glycol butyl ether (DGBE).

The alkanolamine can be selected from triethanolamine, diethanolamine, monoethanolamine and/or any combination thereof, typically, triethanolamine.

The polyol can be selected from triols, diols, glycerin, polyether triols, polyethylene glycol, polypropylene glycol, poly(tetramethylene ether)glycol and/or any combination thereof. Typically, the polyol is a polyether triol.

The sulfosuccinate can be selected from alkyl sulfosuccinates, alkyl sodium sulfonates, dialkyl sulfosuccinates and/or any combination thereof. In one embodiment, the sulfosuccinate is of formula (I):

(I)

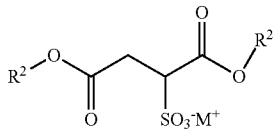

In the above structure $R_2$ is selected from the group consisting of alkyl, —CH2CH2OH, aryl, alkaryl, alkoxy, alkylarylalkyl, arylalkyl, alkylamidoalkyl and alkylaminoalkyl. In embodiments in which $R_2$ represents alkyl, the group typically has about 5 to about 20 carbon atoms and more typically has about 10 to about 18 carbon atoms. In embodiments in which $R_2$ represents aryl, the group typically comprises a phenyl, diphenyl, diphenylether, or naphthalene moiety. "M" is hydrogen, an alkali metal such as sodium or potassium, or an ammonium salt. "M" is typically an alkali metal such as sodium or potassium, more typically sodium.

In one specific embodiment, described herein are heavy oil cleaning compositions comprising: a) from about 1% to about 50% (in some embodiments from about 1% to about 15%) by weight of the composition, a solvent extender comprising a blend of dibasic esters (the blend of dibasic esters, in one embodiment, comprising dialkyl methylglutarate and at least one of a dialkyl adipate or dialkyl ethylsuccinate); b) from about 10% to about 50% (in some embodiments from about 1% to about 40%) by weight of the composition, at least one terpene-based solvent; c) from about 0.1% to about 7% by weight of the composition, at least one glycol ether; d) from about 0.1% to about 7% by weight of the composition, at least one alkanolamine; e) from about 0.1% to about 7% by weight of the composition, at least one polyol; f) from about 1% to about 35% by weight of the composition, at least one sulfosuccinate; and g) from about 1% to about 60% (in some embodiments from about 1% to about 30%) by weight of the composition, water.

Also described herein are methods of cleaning surfaces soiled with one or more heavy oils comprising: (a) providing any of the cleaning compositions described herein; (b) contacting the cleaning composition with a surface soiled with a heavy oil; and (c) removing the used cleaning composition from the surface through spray washing.

In another aspect, described herein are methods for delivering a solvent at reduced concentration comprising the steps of: a) obtaining a terpene-based solvent; and b) mixing the terpene-based solvent with a carrier fluid (the carrier fluid comprising a microemulsion of i) a blend of dibasic esters selected from the group consisting of dialkyl methylglutarate, dialkyl adipate, dialkyl ethylsuccinate, dialkyl succinate, dialkyl glutarate and any combination thereof, ii) at least one surfactant selected from the group consisting of a terpene alkoxylate, an alcohol alkoxylate and any combination thereof; and iii) water) in order to obtain a mixture, whereby the efficacy) or efficiency of the reduced terpene-concentration mixture is equal or greater than that of the solvent terpenes without the solvent extender described herein. In one embodiment, the terpene-based solvent comprises d-limonene. In one embodiment, the terpene-based solvent comprises d-limonene and water. In yet another embodiment, the blend of dibasic esters selected from the group consisting of dialkyl methylglutarate, and at least one of dialkyl adipate or dialkyl ethylsuccinate.

The one or more co-solvents that can be included in said cleaning composition embodiment include, but are not limited to, saturated hydrocarbon solvents, glycol ethers, fatty acid methyl esters, aliphatic hydrocarbons solvents, acyclic hydrocarbons solvents, halogenated solvents, aromatic hydrocarbon solvents, cyclic terpenes, unsaturated hydrocarbon solvents, halocarbon solvents, polyols, ethers, glycol esters, alcohols, ketones, and any combination thereof. The addition of such a co-solvent can cause the solvent blend: surfactant ratio in the composition to increase.

In one embodiment, the blend of dibasic esters comprising the solvent extender is a microemulsion comprising (a) a blend of about 70-90% dialkyl dimethylglutarate, about 5-30% dialkyl ethylsuccinate and about 0-10% dialkyl adipate; (b) a nonionic surfactant composition comprising i) a branched alcohol alkoxylate or linear alcohol alkyxylate or both; and (d) water. Each alkyl substituent individually chosen from a hydrocarbon group containing from about 1 to 8 hydrocarbons such as methyl or ethyl, propyl, isopropyl, butyl, n-butyl or pentyl, or iso-amyl groups. Optionally, one or more additives or additional components such as delaminating agents, buffering and/or pH control agents, fragrances, opacifying agents, anti-corrosion agents, whiteners, defoamers, dyes, sudsing control agents, stabilizers, thickeners and the like can be added to the composition.

According to one embodiment of the present invention, the blend of dibasic esters corresponds to one or more by-products of the preparation of adipic acid, which is one of the main monomers in polyamides. For example, the dialkyl esters are obtained by esterification of one by-product, which generally contains, on a weight basis, from 15 to 33% succinic acid, from 50 to 75% glutaric acid and from 5 to 30% adipic acid. As another example, the dialkyl esters are obtained by esterification of a second by-product, which generally contains, on a weight basis, from 30 to 95% methyl glutaric acid, from 5 to 20% ethyl succinic acid and from 1 to 10% adipic acid. It is understood that the acid portion may be derived from such dibasic acids such as, adipic, succinic, glutaric, oxalic, malonic, pimelic, suberic and azelaic acids, as well as mixtures thereof.

In some embodiments, the dibasic ester blend comprises adducts of alcohol and linear diacids, the adducts having the formula R—OOC-A-COO—R wherein R is ethyl and A is a mixture of —$(CH_2)_4$—, —$(CH_2)_3$, and —$(CH_2)_2$—. In other embodiments, the blend comprises adducts of alcohol, typically ethanol, and linear diacids, the adducts having the formula $R^1$—OOC-A-COO—$R^2$, wherein at least part of $R^1$ and/or $R^2$ are residues of at least one linear alcohol having 4 carbon atoms, and/or at least one linear or branched alcohol having at least 5 carbon atoms, and wherein A is a divalent linear hydrocarbon. In some embodiments A is one or a mixture of —$(CH_2)_4$—, —$(CH_2)_3$, and —$(CH_2)_2$—.

In another embodiment, the $R^1$ and/or $R^2$ groups can be linear or branched, cyclic or noncyclic, $C_1$-$C_{20}$ alkyl, aryl, alkylaryl or arylalkyl groups. Typically, the $R^1$ and/or $R^2$ groups can be $C_1$-$C_8$ groups, for example groups chosen from the methyl, ethyl, n-propyl, isopropyl, n-butyl, n-amyl, n-hexyl, cyclohexyl, 2-ethylhexyl and isooctyl groups and their mixtures. For example, $R^1$ and/or $R^2$ can both or individually be ethyl groups, $R^1$ and/or $R^2$ can both or individually be n-propyl groups, $R^1$ and/or $R^2$ can both or individually be isopropyl groups, $R^1$ and/or $R^2$ can both or individually be n-butyl groups, $R^1$ and/or $R^2$ can both or individually be iso-amyl groups, $R^1$ and/or $R^2$ can both or individually be n-amyl groups, or $R^1$ and/or $R^2$ can be mixtures thereof (e.g., when comprising a blend of dibasic esters).

In further embodiments the invention can include blends comprising adducts of branched diacids, the adducts having the formula $R^3$—OOC-A-COO—$R^4$ wherein $R^3$ and $R^4$ are the same or different alkyl groups and A is a branched or linear hydrocarbon. Typically, A comprises an isomer of a $C_4$ hydrocarbon. Examples include those where $R^3$ and/or $R^4$ can be linear or branched, cyclic or noncyclic, $C_1$-$C_{20}$ alkyl, aryl, alkylaryl or arylalkyl groups. Typically, $R^3$ and $R^4$ are independently selected from the group consisting of methyl, ethyl, propyl, isopropyl, butyl, n-butyl, iso-butyl, iso-amyl, and fusel.

In yet another embodiment, the invention comprises a composition based on dicarboxylic acid diester(s) of formula $R^5$—OOC-A-COO—$R^6$ wherein group A represents a divalent alkylene group typically in the range of, on average, from 2.5 to 10 carbon atoms. $R^5$ and $R^6$ groups, which can be identical or different, represent a linear or branched, cyclic or noncyclic, $C_1$-$C_{20}$ alkyl, aryl, alkylaryl or an arylalkyl group.

The blend can correspond to a complex reaction product, where mixtures of reactants are used. For example, the reaction of a mixture of HOOC-$A^a$-COON and HOOC-$A^b$-COOH with an alcohol $R^a$—OH can give a mixture of the products $R^a$OOC-$A^a$-COO$R^a$ and $R^a$OOC-$A^b$-COO$R^a$. Likewise, the reaction of HOOC-$A^a$-COOH with a mixture of alcohols $R^a$—OH and $R^b$—OH can give a mixture of the products $R^a$OOC-$A^a$-COO$R^a$ and $R^b$OOC-$A^a$-COO$R^b$, $R^a$OOC-$A^a$-COO$R^b$ and $R^b$OOC-$A^a$-COO$R^a$ (different from $R^a$OOC-$A^a$-COO$R^b$ if $A^a$ is not symmetrical). Likewise, the reaction of a mixture of HOOC-$A^a$-COOH and HOOC-$A^b$-COOH with a mixture of alcohols $R^a$—OH and $R^b$—OH can give a mixture of the products $R^a$OOC-$A^a$-COO$R^a$ and $R^b$OOC-$A^a$-COO$R^b$, $R^a$OOC-$A^a$-COO$R^b$, $R^b$OOC-$A^a$-COO$R^a$ (different from $R^a$OOC-$A^a$-COO$R^b$ if $A^a$ is not symmetrical), $R^a$OOC-$A^b$-COO$R^a$ and $R^b$OOC-$A^b$-COO$R^b$, $R^a$OOC-$A^b$-COO$R^b$ and $R^b$OOC-$A^b$-COO$R^a$ (different from $R^a$OOC-$A^b$-COO$R^b$ if $A^b$ is not symmetrical).

The groups $R^1$ and $R^2$, can correspond to alcohols $R^1$—OH and $R^2$—OH (respectively). These groups can be likened to the alcohols. The group(s) A, can correspond to one or more dicarboxylic acid(s) HOOC-A-COOH. The group(s) A can be likened to the corresponding diacid(s) (the diacid comprises 2 more carbon atoms than the group A).

In one embodiment, group A is a divalent alkylene group comprising, on average, more than 2 carbon atoms. It can be a single group, with an integral number of carbon atoms of greater than or equal to 3, for example equal to 3 or 4. Such a single group can correspond to the use of a single acid. Typically, however, it corresponds to a mixture of groups corresponding to a mixture of compounds, at least one of which exhibits at least 3 carbon atoms. It is understood that the mixtures of groups A can correspond to mixtures of different isomeric groups comprising an identical number of carbon atoms and/or of different groups comprising different numbers of carbon atoms. The group A can comprise linear and/or branched groups.

According to one embodiment, at least a portion of the groups A corresponds to a group of formula —$(CH_2)_n$— where n is a mean number greater than or equal to 3. At least a portion of the groups A can be groups of formula —$(CH_2)_4$— (the corresponding acid is adipic acid). For example, A can be a group of formula —$(CH_2)_4$—, and/or a group of formula —$(CH_2)_3$—.

In one embodiment, the composition comprises compounds of formula R—OOC-A-COO—R where A is a group of formula —$(CH_2)_4$—, compounds of formula R—OOC-A-COO—R where A is a group of formula —$(CH_2)_3$—, and compounds of formula R—OOC-A-COO—R where A is a group of formula —$(CH_2)_2$—.

The blend of dibasic esters is typically present in the cleaning composition in microemulsion form (liquid droplets dispersed in the aqueous phase). Without wishing to be bound to any theory, it is pointed out that microemulsions are generally thermodynamically stable systems generally comprising emulsifiers, meaning it is at its lowest energy state. Microemulsions can be prepared by gently mixing or gently shaking the components together. The other emulsions (macroemulsions) are generally systems in thermodynamically unstable state (are only kinetically stable), conserving for a certain time, in metastable state, the mechanical energy supplied during the emulsification. These systems generally comprise smaller amounts of emulsifiers.

In one embodiment, the microemulsion of the present invention is an emulsion whose mean droplet size is generally less than or equal to about 0.15 μm. The size of the microemulsion droplets may be measured by dynamic light scattering (DLS), for example as described below. The apparatus used consists, for example, of a Spectra-Physics 2020 laser, a Brookhaven 2030 correlator and the associated computer-based equipment. If the sample is concentrated, it may be diluted in deionized water and filtered through a 0.22 μm filter to have a final concentration of 2% by weight. The diameter obtained is an apparent diameter. The measurements are taken at angles of 90° and 135°. For the size measurements, besides the standard analysis with cumulents, three exploitations of the autocorrelation function are used (exponential sampling or EXPSAM described by Prof. Pike, the "Non Negatively Constrained Least Squares" or NNLS method, and the CONTIN method described by Prof Provencher), which each give a size distribution weighted by the scattered intensity, rather than by the mass or the number. The refractive index and the viscosity of the water are taken into account.

According to one embodiment, the microemulsion is transparent. The microemulsion may have, for example, a transmittance of at least 90% and preferably of at least 95% at a wavelength of 600 nm, for example measured using a Lambda 40 UV-visible spectrometer.

According to another embodiment, the emulsion is an emulsion whose mean droplet size is greater than or equal to 0.15 μm, for example greater than 0.5 μm, or 1 μm, or 2 μm, or 10 μm, or 20 μm, and preferably less than 100 μm. The droplet size may be measured by optical microscopy and/or laser granulometry (Horiba LA-910 laser scattering analyzer).

In certain embodiments, the dibasic ester blend comprises:

a diester of formula I:

(I)

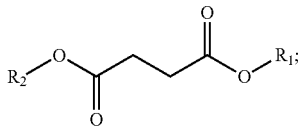

a diester of formula II:

(II)

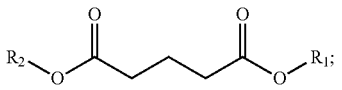

and a diester of formula III:

(III)

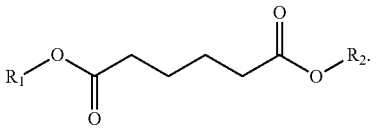

$R_1$ and/or $R_2$ can individually comprise a hydrocarbon having from about 1 to about 8 carbon atoms, typically, methyl, ethyl, propyl, isopropyl, butyl, isobutyl, n-butyl, isoamyl, hexyl, heptyl or octyl. In such embodiments, the blend typically comprises (by weight of the blend) (i) about 15% to about 35% of the diester of formula I, (ii) about 55% to about 70% of the diester of formula II, and (iii) about 7% to about 20% of the diester of formula III, and more typically, (i) about 20% to about 28% of the diester of formula I, (ii) about 59% to about 67% of the diester of formula II, and (iii) about 9% to about 17% of the diester of formula III. The blend is generally characterized by a flash point of 98° C., a vapor pressure at 20° C. of less than about 10 Pa, and a distillation temperature range of about 200-300° C. Mention may also be made of Rhodiasolv® RPDE (Rhodia Inc., Cranbury, N.J.), Rhodiasolv® DIB (Rhodia Inc., Cranbury, N.J.) and Rhodiasolv® DEE (Rhodia Inc., Cranbury, N.J.).

In certain other embodiments, the dibasic ester blend comprises:

a diester of the formula IV:

(IV)

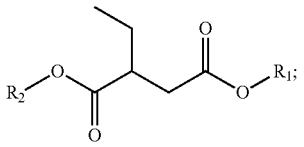

a diester of the formula V:

(V)

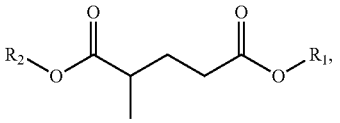

and, optionally, a diester of the formula VI:

(VI)

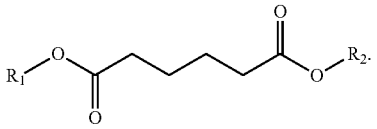

$R_1$ and/or $R_2$ can individually comprise a hydrocarbon having from about 1 to about 8 carbon atoms, typically, methyl, ethyl, propyl, isopropyl, butyl, isobutyl, n-butyl, isoamyl, hexyl, heptyl, or octyl. In such embodiments, the blend typically comprises (by weight of the blend) (i) from about 5% to about 30% of the diester of formula IV, (ii) from about 70% to about 95% of the diester of formula V, and (iii) from about 0% to about 10% of the diester of formula VI. More typically, the blend typically comprises (by weight of the blend): (i) from about 6% to about 12% of the diester of formula IV, (ii) from about 86% to about 92% of the diester of formula V, and (iii) from about 0.5% to about 4% of the diester of formula VI.

Most typically, the blend comprises (by weight of the blend): (i) about 9% of the diester of formula IV, (ii) about 89% of the diester of formula V, and (iii) about 1% of the diester of formula VI. The blend is generally characterized by a flash point of 98° C., a vapor pressure at 20° C. of less than about 10 Pa, and a distillation temperature range of about 200-275° C. Mention may be made of Rhodiasolv® IRIS and Rhodiasolv® DEE/M, manufactured by Rhodia Inc. (manufactured by Rhodia Inc., Cranbury, N.J.)

In another embodiment, the blend comprises one or more of the diesters of formula (I), formula (II), formula (III), formula (IV), formula (V), and/or formula (VI).

In one embodiment, water can include but is not limited to tap water, filtered water, bottled water, spring water, distilled water, deionized water, and/or industrial soft water.

In another embodiment, the solvent can include organic solvents, including but not limited to aliphatic or acyclic hydrocarbons solvents, halogenated solvents, aromatic hydrocarbon solvents, glycol ether, a cyclic terpene, unsaturated hydrocarbon solvents, halocarbon solvents, polyols, ethers, esters of a glycol ether, alcohols including short chain alcohols, ketones or mixtures thereof.

In one embodiment, additional surfactants may be utilized in the present invention. Surfactants that are useful for preparing the microemulsion of the present invention can be one or more anionic surfactants, cationic surfactants, non-ionic surfactants, zwitterionic surfactants, amphoteric surfactants.

Typically nonionic surfactants are utilized, which include but are not limited to polyalkoxylated surfactants, for example chosen from alkoxylated alcohols, alkoxylated fatty alcohols, alkoxylated triglycerides, alkoxylated fatty acids, alkoxylated sorbitan esters, alkoxylated fatty amines, alkoxylated bis(1-phenylethyl)phenols, alkoxylated tris(1-phenylethyl)phenols and alkoxylated alkylphenols, in which the number of alkoxy and more particularly oxyethylene and/or oxypropylene units is such that the HLB value is greater than or equal to 10. More typically, the nonionic surfactant can be selected from the group consisting of ethylene oxide/propylene oxide copolymers, terpene alkoxylates, alcohol ethoxylates, alkyl phenol ethoxylates and combinations thereof.

In one embodiment, the alcohol ethoxylates used in connection with the present invention have the formula:

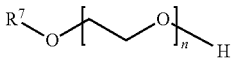

(VIII)

Typically, $R^7$ is a hydrogen or a hydrocarbon chain containing about 5 to about 25 carbon atoms, more typically from about 7 to about 14 carbon atoms, most typically, from about 8 to about 13 carbon atoms, and may be branched or straight-chained and saturated or unsaturated and is selected from the group consisting of hydrogen, alkyl, alkoxy, aryl, alkaryl, alkylarylalkyl and arylalkyl. Typically, "n" is an integer from about 1 to about 30, more typically an integer from 2 to about 20, and most typically an integer from about 3 to about 12. In another embodiment, "n" is an integer from about 3 to about 10.

In another embodiment, the non-ionic surfactant has formula:

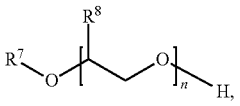

(III)

wherein $R^7$ is a hydrogen or a branched hydrocarbon chain containing from about 5 to about 25 carbon atoms, $R^8$ is a hydrogen or a hydrocarbon chain containing from about 1 to about 5 carbon atoms; "n" is an integer from about 1 to about 30, more typically an integer from 2 to about 20, and most typically an integer from about 3 to about 12. In another embodiment, "n" is an integer from about 3 to about 10.

In an alternative embodiment, the alcohol ethoxylate is sold under the trade name Rhodasurf 91-6 (manufactured by Rhodia Inc., Cranbury, N.J.).

In yet another embodiment, nonionic surfactants used include but not limited to: polyoxyalkylenated C6-C24 aliphatic alcohols comprising from 2 to 50 oxyalkylene (oxyethylene and/or oxypropylene) units, in particular of those with 12 (mean) carbon atoms or with 18 (mean) carbon atoms; mention may be made of Antarox B12DF, Antarox FM33, Antarox FM63 and Antarox V74, Rhodasurf ID 060, Rhodasurf ID 070 and Rhodasurf LA 42 from (Rhodia Inc., Cranbury, N.J.), as well as polyoxyalkylenated C8-C22 aliphatic alcohols containing from 1 to 25 oxyalkylene (oxyethylene or oxypropylene) units.

In a further embodiment, the surfactant comprises a terpene alkoxylate. Terpene alkoxylates are terpene-based surfactants derived from a renewable raw materials such as α-pinene and β-pinene, and have a C-9 bicyclic alkyl hydrophobe and polyoxy alkylene units in an block distribution or intermixed in random or tapered distribution along the hydrophilic chain. The terpene alkoxylate surfactants are described in the U.S. Patent Application Publication No. 2006/0135683 to Adam al., Jun. 22, 2006, is incorporated herein by reference.

In a further or alternative embodiment, additional components or additives may be added to the cleaning composition of the present invention. The additional components include, but are not limited to, delaminates, buffering and/or pH control agents, fragrances, perfumes, defoamers, dyes, whiteners, brighteners, solubilizing materials, stabilizers, thickeners, corrosion inhibitors, lotions and/or mineral oils, enzymes, cloud point modifiers, preservatives, ion exchangers, chelating agents, sudsing control agents, soil removal agents, softening agents, opacifiers, inert diluents, graying inhibitors, stabilizers, polymers and the like.

Typically, additional components comprise one or more delaminates. Delaminates can be certain terpene-based derivatives that can include, but are not limited to, pinene and pinene derivatives, d-limonene, dipentene and oc-pinene.

The buffering and pH control agents include for example, organic acids, mineral acids, as well as alkali metal and alkaline earth salts of silicate, metasilicate, polysilicate, borate, carbonate, carbamate, phosphate, polyphosphate, pyrophosphates, triphosphates, ammonia, hydroxide, monoethanolamine, monopropanolamine, diethanolamine, dipropanolamine, triethanolamine, and/or 2-amino-2-methylpropanol.

More specifically, the buffering agent can be a detergent or a low molecular weight, organic or inorganic material used for maintaining the desired pH. The buffer can be alkaline, acidic or neutral, including but not limited to 2-amino-2-methyl-propanol; 2-amino-2-methyl-1,3-propanol; disodium glutamate; methyl diethanolamide; N,N-bis(2-hydroxyethyl) glycine; tris(hydroxymethyl)methyl glycine; ammonium carbamate; citric acid; acetic acid; ammonia; alkali metal carbonates; and/or alkali metal phosphates.

In still another embodiment, thickeners, when used, include, but are not limited to, cassia gum, tara gum, xanthan gum, locust beam gum, carrageenan gum, gum karaya, gum arabic, hyaluronic acids, succinoglycan, pectin, crystalline polysaccharides, branched polysaccharide, calcium carbonate, aluminum oxide, alginates, guar gum, hydroxypropyl guar gum, carboxymethyl guar gum, carboxymethylhydroxypropyl guar gum, and other modified guar gums, hydroxycelluloses, hydroxyalkyl cellulose, including hydroxyethyl cellulose, carboxymethylhydroxyethyl cellulose, hydroxypropyl cellulose, carboxymethylcellulose and/or other modified celluloses. In a further embodiment, the whiteners include, but are not limited to, percarbonates, peracids, perborates, chlorine-generating substances hydrogen peroxide, and/or hydrogen peroxide-based compounds. In another embodiment, the polymer is generally a water soluble or dispersable polymer having a weight average molecular weight of generally below 2,000,000.

Since dibasic esters are subject to hydrolysis under certain conditions, it is understood that the blend of dibasic esters can contain a minute amount of alcohol, typically a low molecular weight alcohol such as ethanol, in concentrations of about 2% to about 0.2%.

In either concentrated or diluted form, the composition of the present invention is stable, typically up to 6 months or greater, more typically up to 12 months or greater for the diluted form and longer in the concentrated form.

In a first aspect, formulations described herein utilize Rhodiasolv IRIS and Beta pinene (it is understood, however, that beta pinene can be replaced with alpha pinene, d-limonene or other natural terpene) as co-solvents in a microemulsion to dissolve tar sands. Since alpha and beta pinene are better solvents than d-limonene, they can used in lower concentrations to avoid any strong odor issues. In addition, alpha pinene is less of a health hazard than d-limonene. The formulation's performance is comparable or better to that of Megasol, but without the strong odor or dermal irritant effects of d-limonene. The formulations were developed as microemulsions so that they can be washed off the mining equipment using water-jets. This work is also to cover any area were bitumen type cleaners may be necessary, such as asphalt or oil field cleaning.

The composition according to one embodiment of the invention comprises: a) from about 1% to about 90% by weight, of a terpene-based solvent; and b) from about 1% to about 50% by weight of a solvent extender.

Described are methods for preparing a terpene-based solvent at reduced terpene-based solvent concentration comprising the steps of: a) obtaining at least one terpene-based solvent; and b) mixing the terpene-based solvent with a solvent extender comprising a microemulsion of: i) a blend of dibasic esters selected from the group consisting of dialkyl methylglutarate, dialkyl adipate, dialkyl ethylsuccinate, dialkyl succinate, dialkyl glutarate and any combination thereof; ii) at least one surfactant selected from the group consisting of a terpene alkoxylate, an alcohol alkoxylate and any combination thereof; and iii) water; to form a rinsable mixture, wherein the rinsable mixture is capable of cleaning a contaminated substrate.

Also described herein are cleaning compositions comprising: a) a solvent extender comprising a microemulsion of: a(i)) a blend of dibasic esters selected from the group consisting of dialkyl methylglutarate, dialkyl adipate, dialkyl ethylsuccinate, dialkyl succinate, dialkyl glutarate and any combination thereof; a(ii)) at least one surfactant selected from the group consisting of a terpene alkoxylate, an alcohol alkoxylate and any combination thereof; and a(iii)) water; b) at least one terpene-based solvent; and c) water, wherein the composition is rinsable.

The mixture can characterized by a terpene-based solvent to solvent extender weight ratio of from 1:5 to 1:1 of the at least one terpene-based solvent to the solvent extender, respectively. In another embodiment, the mixture can be characterized by a terpene-based solvent to solvent extender weight ratio of from 1:3 to 1:1 of the at least one terpene-based solvent to the solvent extender, respectively. In yet another embodiment, the mixture is characterized by a terpene-based solvent to solvent extender weight ratio of from 1:2 to 1:1 of the at least one terpene-based solvent to the solvent extender, respectively.

Also described herein are methods of cleaning a surface soiled with a tar sand, bitumen, asphaltene, oil or any combination thereof, the method comprising: (a) providing a cleaning composition as described herein; (b) contacting the cleaning composition to a surface soiled with contaminants comprising tar sand, bitumen, asphaltene, oil or any combination thereof; and (c) removing the contaminants from the surface through rinsing.

Also described herein are rinsable heavy oil cleaning compositions comprising: a) at least one terpene-based solvent; b) a solvent extender comprising a microemulsion of: i) a blend of dibasic esters selected from the group consisting of dialkyl methylglutarate, dialkyl adipate, dialkyl ethylsuccinate, dialkyl succinate, dialkyl glutarate and any combination thereof, ii) at least one surfactant selected from the group consisting of a terpene alkoxylate, an alcohol alkoxylate and any combination thereof, and iii) water; c) at least one glycol ether; d) at least one alkanolamine; e) at least one polyol; f) at least one sulfosuccinate; and g) optionally, water.

EXAMPLE 1

All work was benchmarked against the d-limonene-based Megasol, a typical industrial cleaner. The initial work focused on DIB as one of the active ingredients, but eventually included IRIS based formulations. DIB based formulations, which showed improvements in cleaning over Megasol, are listed below:

TABLE 1

| DIB Microemulsion (R0690-194-08) | Weight in grams |
|---|---|
| DIB | 30 |
| +-Alpha pinene | 40 |
| Butyl Carbitol | 5 |
| Triethanol amine | 4 |
| Carpol GP-6015 | 4 |
| Pentex 99 | 24 |
| Water (DI) | 10 |

TABLE 2

| DIB Microemulsion (R0690-194-18) | Weight in grams |
|---|---|
| DIB | 30 |
| d-limonene | 40 |
| Butyl Carbitol | 5 |
| Triethanol amine | 4 |
| Carpol GP-6015 | 4 |
| Pentex 99 | 27.4 |
| Water (DI) | 10 |

TABLE 3

| DIB Microemulsion (R0690-194-28) | Weight in grams |
|---|---|
| DIB | 30 |
| d-limonene | 20 |
| Alpha pinene | 20 |
| Butyl carbitol | 5 |
| Triethanol amine | 4 |
| Carpol GP-6015 | 4 |
| Pentex 99 | 27.6 |
| Water (DI) | 10 |

The results of these formulations can be seen in FIG. 1.

Both R0690-194-08 and R0690-194-18 have the lowest dissolution time for the bitumen. In some cases, higher water content is desired to reduce costs. The following formulations certainly have total water content of 30% (Note: Pentex 99 also has water that was added to the total to achieve 30%).

| DIB Microemulsion (R0833-005-10) | Weight in grams |
|---|---|
| DIB | 10 |
| Beta pinene | 40 |
| Butyl Carbitol | 5 |
| Triethanol amine | 4 |
| Carpol GP-6015 | 4 |
| Pentex 99 | 23.5 |
| Water | 30 |

| IRIS Microemulsion (R0833-001-21) | Weight in grams |
|---|---|
| IRIS | 10 |
| Beta pinene | 40 |
| Butyl Carbitol | 5 |
| Triethanol Amine | 4 |
| Carpol GP-6015 | 4 |
| Pentex 99 | 20 |
| Water | 30 |

Figure 2:
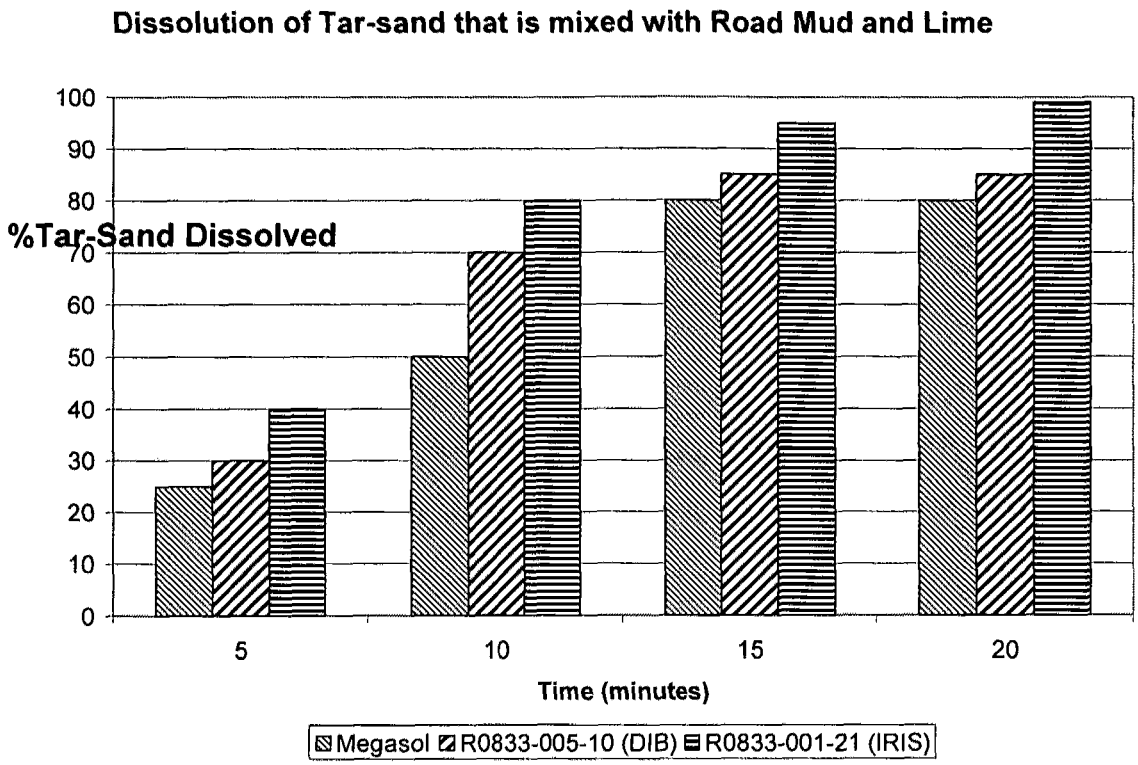
FIG. 2 illustrates the percentage of tar-sand dissolved into the cleaning compositions described herein as well as the benchmark.

Referring to FIGS. 1 and 2, the figures show how IRIS formulations can be used to dissolve bitumen/mud/lime deposits that form on mining equipment. Also when crude terpene fractions are substituted with pinene the resulting formulation can also dissolve bitumen faster (by about 2 minutes) than Megasol.

These results can be applied to asphalt cleaning or any bitumen based cleaning application. It could even be extended to grease and oil clean up.

EXAMPLE 2

Figure 3:
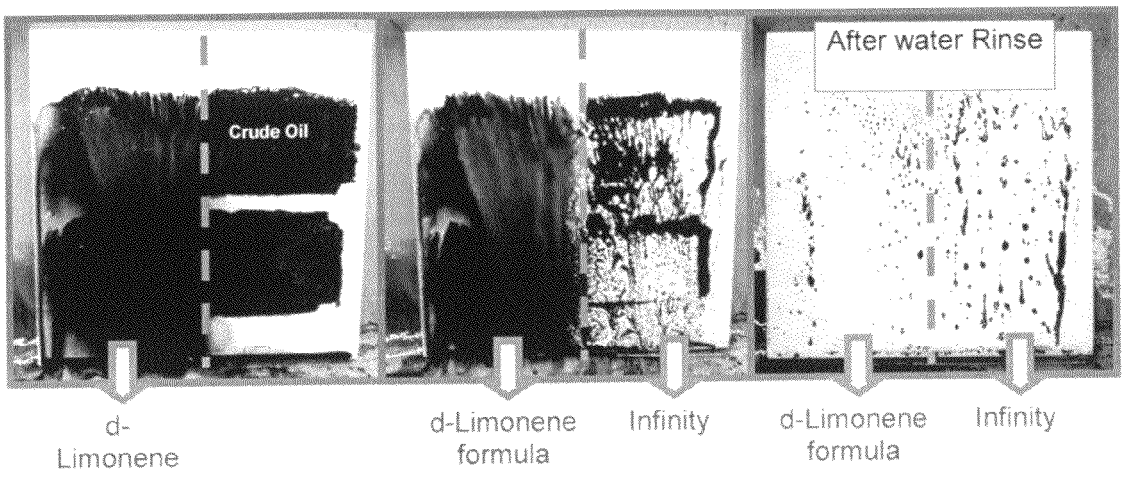
FIG. 3 is a photograph illustrating a comparison of efficacy of a d-limonene formulation (92.5% d-limonene) and Rhodiasolv Infinity in cleaning freshly applied crude oil on a ceramic tile.

Vehicle/Carrier/Extender to Deliver Cleaning Solvent at Reduced Concentrations As shown in FIG. 3, samples of fresh crude oil were tested against the composition of described (Rhodiasolv Infinity) herein versus a d-limonene formulation. Rhodiasolv Infinity, for the purposes of these examples, comprises: from about 30-60%, by weight of the composition, a blend of dibasic esters comprising dialkyl methylglutarate and at least one of a dialkyl adipate or dialkyl ethylsuccinate; from about 30-60%, by weight of the composition, a $C_5$-$C_{20}$ alcohol ethoxylate surfactant; less than about 5%, by weight of the composition, polyethylene glycol; and from about 5-10%, by weight of the composition, a terpene.

Two stripes of crude oil were applied on a tile and allowed to dry only for 3-4 hrs in a ventilated hood (FIGS. 3, 4, and 6) and are referred to as "fresh crude". D-limonene formulation used in the following example was formulated with nonionic surfactant: 92.5% d-limonene with 7.5% Rhodasurf DA-630. The procedure was as follows:

i) 2 sprays of formulation on each stripe; then ii) Light rinse with water on each stripe It was observed that the d-Limonene formulation efficiently dissolves crude (left panel) while Rhodiasolv Infinity as applied nucleates holes and de-wets the crude off surface (middle panel). Rinsing with water shows a greater ease of rinsing off the side of the tile that was cleaned with the d-limonene formula (right panel)

Figure 4:
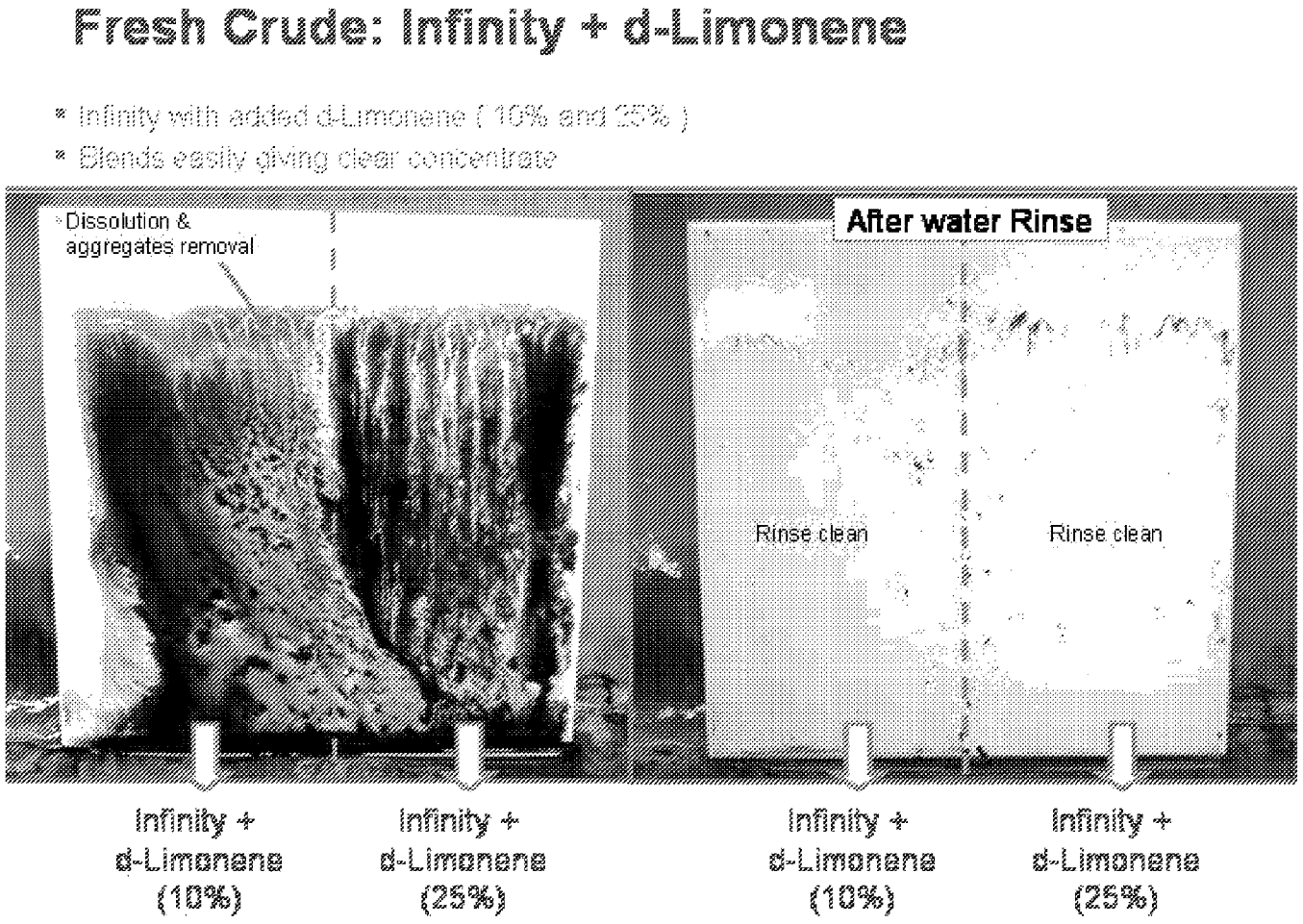
FIG. 4 is a photograph illustrating the efficacy of blends of Rhodiasolv Infinity and 10% d-limonene or 25% d-limonene in cleaning freshly applied crude.

As shown in FIG. 4 for fresh crude applied on a tile, Infinity with added d-Limonene (only 10% and 25%) results in dissolution of the fresh crude similar to the d-limonene formulation. Some aggregates of crude were also observed to be removed. It was observed that the respective blends give clear concentrate. Rinsing with water appears to easily remove the crude from the surface, equivalent or better than the d-limonene formulation alone.

Figure 5:
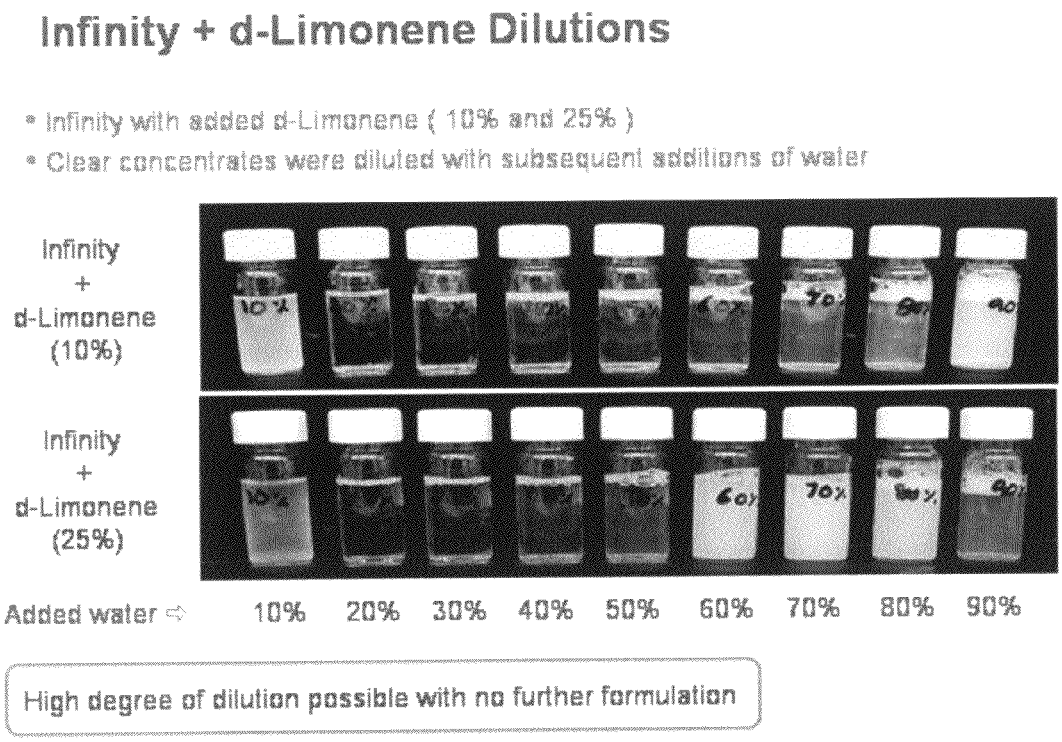
FIG. 5 is a photograph illustrating dilution lines of blends of Rhodiasolv Infinity and (Top row) 10% d-limonene or (Bottom row) 25% d-limonene.

FIG. 5 shows dilution lines of blends of Rhodiasolv Infinity and (Top row) 10% d-limonene or (Bottom row) Infinity and 25% d-limonene. On addition of water, the clear blends above become turbid at 10% added water and then become clear stable microemulsions. Infinity +10% d-limonene may be diluted to 80% water while Infinity +25% d-limonene may be diluted to 50% added water to give stable and clear emulsions.

Figure 6:
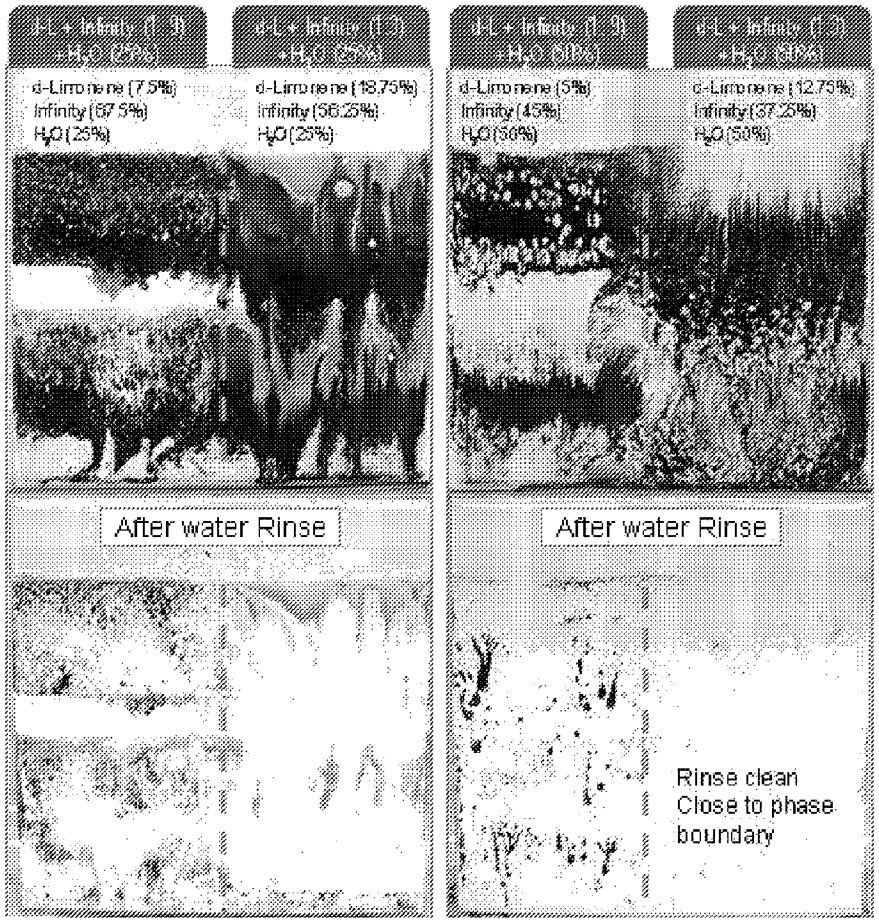
FIG. 6 is a photograph illustrating the efficacy of aqueous DILUTIONS of blends of (1:9) d-limonene and Rhodiasolv Infinity or (1:3) d-limonene and Rhodiasolv Infinity in cleaning freshly applied crude.

FIG. 6 illustrates efficacy of aqueous dilutions of blends of (1:9) d-limonene and Rhodiasolv Infinity or (1:3) d-limonene and Rhodiasolv Infinity in cleaning freshly applied crude. The (1:9) blend and (1:3) blend are diluted with 25% and 50% added water. The final compositions of the cleaning solutions are labeled on the tile in FIG. 6. It was found that with added water (25% or 50%), the (1:3) blend of d-limonene and Infinity was fairly effective in cleaning fresh crude oil.

Figure 7:
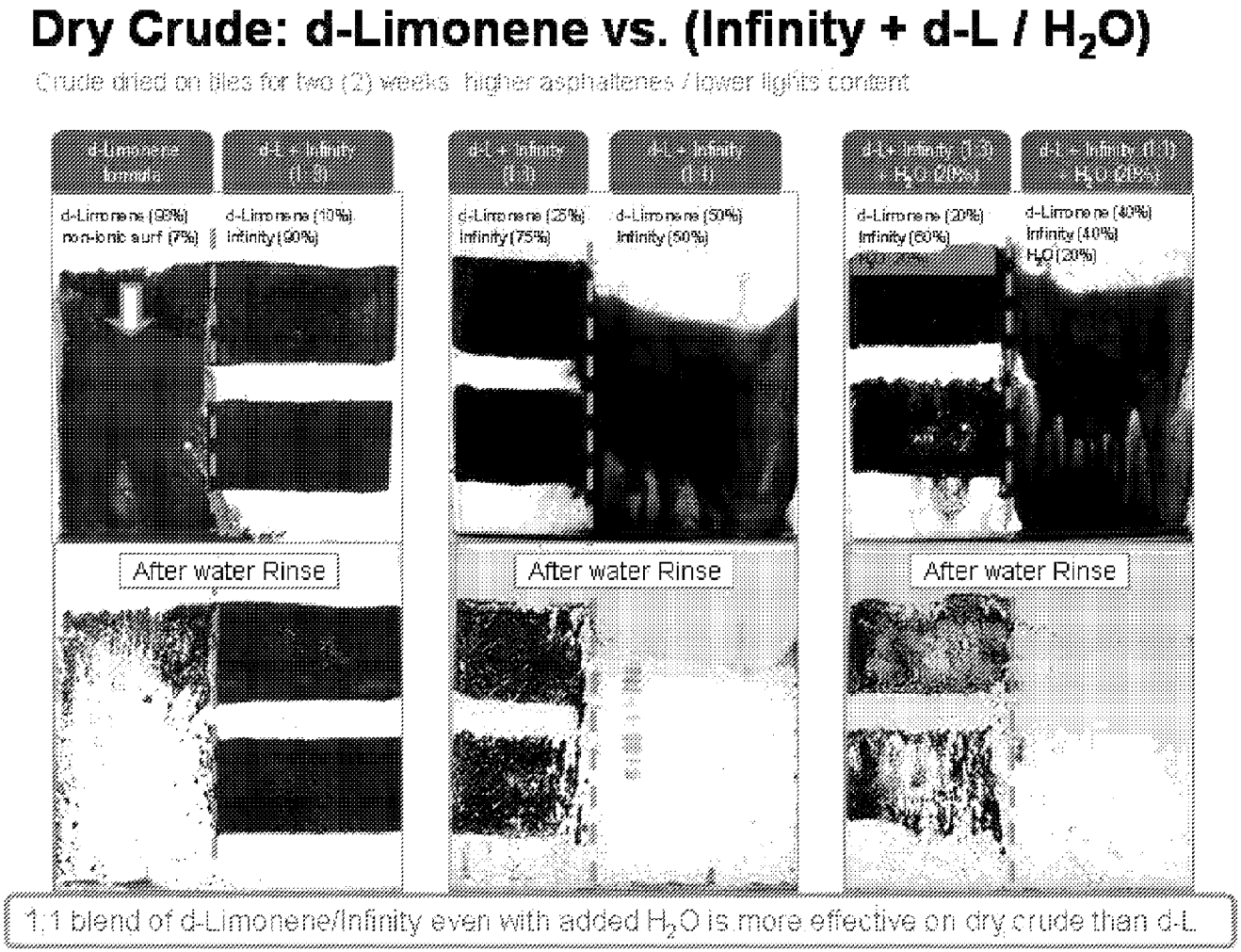
FIG. 7 is a photograph illustrating comparisons for cleaning "dry" crude. D-Limonene formulation (92.5% d-limonene) is compared with d-limonene/Infinity blends at (1:9), (1:3) and (1:1) levels. Further the right panels (top/bottom) show the efficacy of the (1:3) and (1:1) blends with added 20% water in cleaning dry crude

FIG. 7 shows comparisons for cleaning "dry" crude. The dry crude panels were prepared by applying 2 stripes of crude oil on tiles and allowing them to air dry for 2 weeks in a ventilated hood. The drying process would allow all the volatiles from the crude to evaporate leaving a heavier fraction rich in asphaltenes or bitumen. D-limonene formulation (92.5% d-limonene) is compared with d-limonene/Infinity blends at (1:9), (1:3) and (1:1) levels. The top row is for the cleaning solutions as applied on the "dry" crude stripes. The bottom row is for the same panels in the corresponding top row after rinsing with water. The (1;9) and the (1:3) blends appear to have minimal effect on "dry" crude. The (1:1) blend however seems to have a significant impact in dissolving the dry crude. Further the (1:1) blend appears to de-wet the crude off the tile as it flows down. This can be easily rinsed off the surface showing effective cleaning at a substantially reduced d-limonene content. Further the right panels (top/bottom) show the efficacy of the (1:3) and (1:1) blends with added 20% water in cleaning dry crude. The (1:1) blend with 20% added water shows similar behavior showing efficacy at even further reduced levels of d-limonene as a water diluted oil-continuous microemulsion.

The present invention, therefore, is well adapted to carry out the objects and attain the ends and advantages mentioned, as well as others inherent therein. While the invention has been depicted and described and is defined by reference to particular preferred embodiments of the invention, such references do not imply a limitation on the invention, and no such limitation is to be inferred. Consequently, the invention is intended to be limited only by the spirit and scope of the appended claims, giving full cognizance to equivalents in all respects.

The invention claimed is:

1. A method of cleaning a surface soiled with heavy oil selected from the group consisting of tar sand, bitumen, asphaltene, crude oil or any combination thereof comprising applying to the soiled surface a stable microemulsion formed by mixing:

a) one part of at least one terpene-based solvent; and b) one to five parts of a solvent extender comprising i) a blend of dibasic esters selected from the group consisting of dialkyl methylglutarate, dialkyl adipate, dialkyl ethylsuccinate, dialkyl succinate, dialkyl glutarate and any combination thereof; and ii) at least one surfactant selected from the group consisting of a terpene alkoxylate, an alcohol alkoxylate and any combination thereof; and c) water;

and then rinsing the soiled surface.

2. The method of claim 1 wherein the at least one terpene-based solvent comprises d-limonene.

3. The method of claim 1 comprising one to three parts b).

4. The method of claim 1 comprising one to two parts b).

5. The method of claim 1 wherein the blend of dibasic esters comprises dialkyl methylglutarate and dialkyl ethylsuccinate.

6. The method of claim 1 wherein the at least one surfactant is of formula:

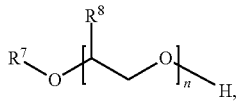

wherein $R^7$ is a hydrogen or a branched or linear hydrocarbon chain containing from about 5 to about 25 carbon atoms; $R^8$ is a hydrogen or a hydrocarbon chain containing from about 1 to about 5 carbon atoms; and -n- is an integer from about 1 to about 30.

* * * * *